US006031501A

United States Patent [19]

Rausch et al.

[11] Patent Number: 6,031,501

[45] Date of Patent: Feb. 29, 2000

[54] LOW COST COMPACT ELECTRONICALLY SCANNED MILLIMETER WAVE LENS AND METHOD

[75] Inventors: Ekkehart O. Rausch; Andrew F. Peterson, both of Atlanta, Ga.

[73] Assignee: Georgia Tech Research Corporation, Atlanta, Ga.

[21] Appl. No.: 08/820,166

[22] Filed: Mar. 19, 1997

[51] Int. Cl.[7] ..... H01Q 19/06

[52] U.S. Cl. ..... 343/754; 343/753; 343/768; 343/776

[58] Field of Search ..... 343/753, 754, 343/756, 768, 776; 342/368; 385/132, 50, 33

[56] References Cited

U.S. PATENT DOCUMENTS

| | | | |
|---|---|---|---|
| 3,170,158 | 2/1965 | Rotman | 343/100 |
| 3,369,242 | 2/1968 | Johnson | 343/754 |
| 3,534,374 | 10/1970 | Johnson | 343/768 |
| 3,604,009 | 9/1971 | Behnke | 343/754 |
| 3,680,140 | 7/1972 | Chalfin et al. | 343/754 |
| 3,852,762 | 12/1974 | Henf et al. | 343/756 |
| 3,964,069 | 6/1976 | McDonough | 343/754 |
| 3,979,754 | 9/1976 | Archer | 343/754 |
| 4,021,810 | 5/1977 | Urpo et al. | 343/731 |
| 4,042,931 | 8/1977 | Gustafsson | 343/117 R |
| 4,086,597 | 4/1978 | Sinsky et al. | 343/754 |
| 4,114,162 | 9/1978 | Wild | 343/754 |
| 4,186,398 | 1/1980 | Minnett et al. | 343/100 SA |
| 4,203,117 | 5/1980 | Jacobs et al. | 343/701 |
| 4,243,990 | 1/1981 | Nemit et al. | 343/771 |
| 4,288,795 | 9/1981 | Shelton | 343/754 |
| 4,348,678 | 9/1982 | Thomas | 343/754 |
| 4,348,679 | 9/1982 | Shnitkin et al. | 343/768 |
| 4,381,509 | 4/1983 | Rotman et al. | 343/754 |
| 4,408,205 | 10/1983 | Hockham | 343/16 |
| 4,413,263 | 11/1983 | Amitay et al. | 343/756 |
| 4,458,249 | 7/1984 | Valentino et al. | 343/754 |
| 4,490,723 | 12/1984 | Hardie et al. | 343/754 |
| 4,575,727 | 3/1986 | Stern et al. | 343/768 |
| 4,588,994 | 5/1986 | Tang et al. | 343/754 |
| 4,612,547 | 9/1986 | Itoh | 343/372 |
| 4,636,799 | 1/1987 | Kubick | 343/754 |
| 4,641,144 | 2/1987 | Prickett | 343/754 |
| 4,721,960 | 1/1988 | Lait | 342/368 |
| 4,721,966 | 1/1988 | McGrath | 343/754 |
| 4,809,011 | 2/1989 | Kunz | 343/754 |

(List continued on next page.)

OTHER PUBLICATIONS

P.S. Hall et al., "Review of Radio Frequency Beamforming Techniques for Scanned and Multiple Beam Antennas" IEE Proceedings, vol. 137, Pt.H, No. 5, Oct., 1990.

W. Rotman et al., "Wide–Angle Microwave Lens for Line Source Applications" IEEE Transactions on Antennas and Propagation, Nov., 1963, pp. 623–632.

*Primary Examiner*—Don Wong
*Assistant Examiner*—Hoang Nguyen
*Attorney, Agent, or Firm*—Thomas, Kayden, Horstemeyer & Risley

[57] ABSTRACT

A low cost, compact, electronically scanned millimeter wave (MMW) lens enables the projection of a highly directional beam of Ka band millimeter wave (MMW) electromagnetic energy, while eliminating the need for mechanical movement of the lens. The present invention allows for the economical production and operation of the lens in the Ka and higher frequency ranges by exploiting waveguide technology. The waveguides of the present invention are tapered longitudinally resulting in a wider portion of the waveguide in electromagnetic communication with an interior cavity of the lens. The waveguide taper improves impedance matching between the waveguides and the lens cavity. The waveguides also include symmetric power dividers, located longitudinally within the waveguide aperture, ensuring port widths below $\lambda_g/2$, thus, reducing or eliminating unwanted mode components which reduces sidelobe energy. This results in a low loss, low sidelobe steerable beam of MMW energy.

9 Claims, 7 Drawing Sheets

U.S. PATENT DOCUMENTS

| | | | |
|---|---|---|---|
| 4,862,186 | 8/1989 | Strider | 343/776 |
| 4,864,308 | 9/1989 | Raab et al. | 342/351 |
| 5,003,315 | 3/1991 | Skatvold et al. | 342/373 |
| 5,081,465 | 1/1992 | Collignon | 343/754 |
| 5,128,687 | 7/1992 | Fay | 343/754 |
| 5,162,803 | 11/1992 | Chen | 342/372 |
| 5,184,136 | 2/1993 | Cardiasmenos | 342/153 |
| 5,201,065 | 4/1993 | Niehenke | 455/83 |
| 5,202,692 | 4/1993 | Huguenin et al. | 342/179 |
| 5,237,334 | 8/1993 | Waters | 343/753 |
| 5,264,859 | 11/1993 | Lee et al. | 343/754 |
| 5,357,260 | 10/1994 | Roederer et al. | 343/754 |
| 5,495,258 | 2/1996 | Muhlhauser et al. | 343/753 |
| 5,677,697 | 10/1997 | Lee et al. | 342/368 |

LOW COST COMPACT ELECTRONICALLY SCANNED MILLIMETER WAVE LENS AND METHOD

CROSS REFERENCE TO RELATED APPLICATION

This application claims priority to and the benefit of the filing date of copending and commonly assigned provisional application entitled LOW COST COMPACT ELECTRONICALLY SCANNED MILLIMETER WAVE ANTENNA, assigned Ser. No. 60/013,734, and filed Mar. 20, 1996; and copending and commonly assigned provisional application entitled LOW COST COMPACT ELECTRONICALLY SCANNED MILLIMETER WAVE ANTENNA, assigned Ser. No. 60/029,877, and filed on Dec. 3, 1996.

FIELD OF THE INVENTION

The present invention relates generally to the transmission of electromagnetic waves, and more particularly, to a low cost, compact, electronically scanned, millimeter wave (MMW) lens and method for directing an electromagnetic beam at millimeter wave frequencies, with very low losses, without requiring mechanical movement of the lens.

BACKGROUND OF THE INVENTION

Most MMW antennas that operate at frequencies equal to or greater than 35 GHz use either a mechanical scanning approach or phase shifters for electronic steering. Phase shifters that operate at MMW frequencies are costly and introduce considerable RF losses. Mechanically steered antennas contain moving parts; are slow in response; and can be sensitive to shock and vibration. For this reason different beamforming antennas were investigated. Although most beamformers excel in one category, for example, greater scan range or bandwidth, only the Rotman lens offers a good compromise in performance for most categories. For example, see the following references: Y. T. Lo and S. W. Lee, Antenna Handbook: *Theory, Appications and Design*, Van Nostrand Reinhold Co., New York, N.Y., 1988; P. S. Hall and S. J. Vetterlein, *Review of Radio Frequency Beamforming Techniques for Scanned and Multiple Beam Antennas*, IEEE Proc., Vol. 137, Pt. H, No. 5, pp. 293–303, October 1990; and W. Rotman and R. F. Turner, *Wide Angle Lens for Line Source Applications*, IEEE Trans. Ant. Propogation. Vol. AP-11, pp. 623–632, November 1963.

In the past, Rotman lenses have been implemented with microstrip or stripline technology, which limits their use to between 6 and 18 GHz. The present invention enables the use of Rotman lenses at frequencies greater than approximately 18 GHz, especially in the millimeter wave region between 30 and 100 GHz.

Millimeter Wave (MMW) components are compact and well suited for integration into missile seeker heads, smart munitions, automobile collision avoidance systems, and synthetic vision systems. In these applications, low cost, rapid inertialess scanning of the antenna is desirable.

SUMMARY OF THE INVENTION

The present invention provides for a low cost, compact, electronically scanned millimeter wave lens, using a Rotman lens, that allows efficient operation in the Ka band and higher frequency range, thus, allowing the economical production of an electronically scanned lens that operates at frequencies as high as 95 GHz. In order to minimize losses, the lens of the present invention is implemented using waveguide technology.

In architecture, the preferred embodiment of the lens is a two piece structure that consists of two symmetrical parallel plates, or lens halves, having waveguide ports distributed around the periphery of the plates. A first lens half contains impedance matching structures as is known in the art. In addition, a second lens half includes a rectangular aperture in each waveguide coupler that contains a millimeter wave energy absorber designed to terminate millimeter wave energy at the difference port of the forward folded hybrid tee coupler, as is known in the art. Beam-forming, or beam ports, are located on one side of each lens half. These ports are fed by a switch array that provides the input MMW energy to the beam ports of the present invention. The array ports are located on the opposite side of each lens half, each connected to an antenna element. The array ports transfer the MMW energy to the antenna elements. A specially shaped internal cavity, formed into each lens half, provides a transmission medium which electromagnetically couples the beam ports to the array ports. The shape of the internal cavity dictates the beam and array port contours. The waveguide cavities of both the beam ports and the array ports are tapered, with the wider end in communication with the specially shaped internal cavity. The waveguide taper at the cavity boundary provides a better impedance match between the waveguides and the internal cavity.

The beam and array ports, or waveguides, are designed with a symmetric power divider longitudinally placed in the center of each waveguide. This symmetric power divider extends longitudinally along the length of the waveguide. This symmetric power divider creates parallel waveguide cavities that are smaller than ½ of the wavelength of an electromagnetic wave passing through the waveguide, and therefore, significantly reduces electromagnetic coupling into higher order modes at adjacent waveguide ports and, thus, also reduces the sidelobe radiation of the main electromagnetic beam.

Placed in the opposing distal ends of the interior cavity sidewalls are blocks of MMW energy absorbing material. These blocks are shaped so as to absorb and minimize the amount of electromagnetic energy reflected from the sidewalls of each lens half. In addition, the sidewalls of the preferred embodiment are triangular in shape so as to minimize and contain reflected multipath energy by confining the multipath energy within the triangular shaped sidewall region. The unique design of the waveguides, coupled with the reflected multipath energy minimizing shape of the cavity, reduces the sidelobe energy for the desired scan angles, as well as other angles between +/−90° directivity.

MMW electromagnetic energy, input into a specific beam port, will emerge from all array ports and produce a beam along a particular direction. Switching the input from beam port to beam port will steer the beam electronically in one dimension.

A complete antenna system requires that the lens be connected to a switch network and an array of antenna elements (in this case, horn antennas). This switch network and antenna system is not part of the present invention, and therefore, will not be discussed in detail.

The invention has numerous advantages, a few of which are delineated hereafter, as merely examples.

An advantage of the low cost, compact electronically scanned MMW lens is that it operates in the Ka and higher frequency band, thus extending the capabilities of a steerable Rotman lens antenna to the millimeter wave region.

Another advantage of the present invention is that it can be fabricated from metallized plastic, thus reducing cost.

Another advantage of the present invention is that it has very low losses in the millimeter wave region compared to a Rotman lens constructed using microstrip or stripline technology.

Another advantage of the present invention is that the symmetric power dividers allow for the superior reduction of sidelobe energy associated with a directed electromagnetic beam.

Another advantage of the present invention is that it can function as a low loss power divider that can be used as a feed for other antennas.

Another advantage of the present invention is that it is simple in design, reliable in operation, and its design lends itself to economical mass production in plastic or other inexpensive materials.

Other objects, features, and advantages of the present invention will become apparent to one with skill in the art upon examination of the following drawings and detailed description. It is intended that all such additional objects, features, and advantages be included herein within the scope of the present invention, as defined in the appended claims.

BRIEF DESCRIPTION OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF THE PREFERRED EMBODIMENT

While the foregoing preferred embodiment is realized using complementary lens halves fabricated of metal, each having features of beam waveguides, array waveguides and an internal cavity, other embodiments of the present invention are possible. For example, it is possible to form the waveguides and the internal cavity in plastic, or other low cost material thus reducing overall cost.

LENS ANALYSIS MODEL

Figure 1:
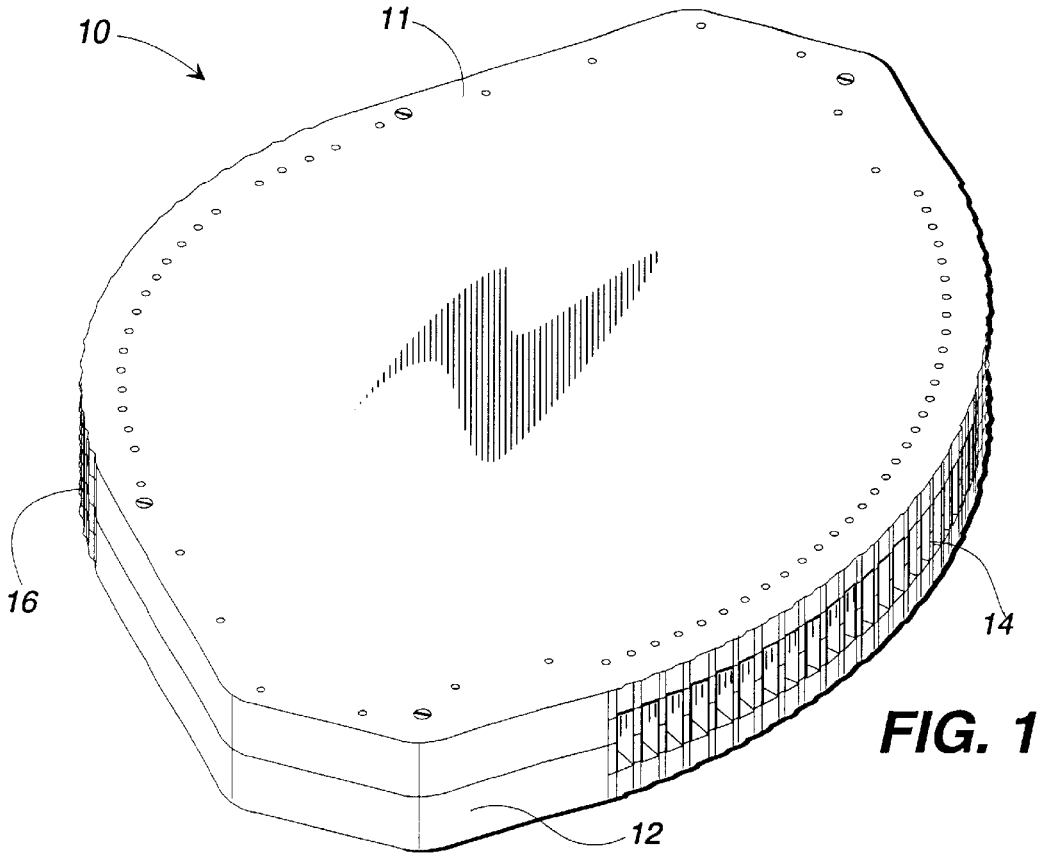
FIG. 1 is an isometric view of the preferred embodiment of the electronically scanned lens of the present invention.

Referring to FIG. 1, shown is an isometric view of the preferred embodiment of the Rotman lens of the present invention. The preferred embodiment is comprised of a first lens half 11 and a second lens half 12. When mated, the lens halves form beam waveguides 14 and array waveguides 16.

Figure 2:
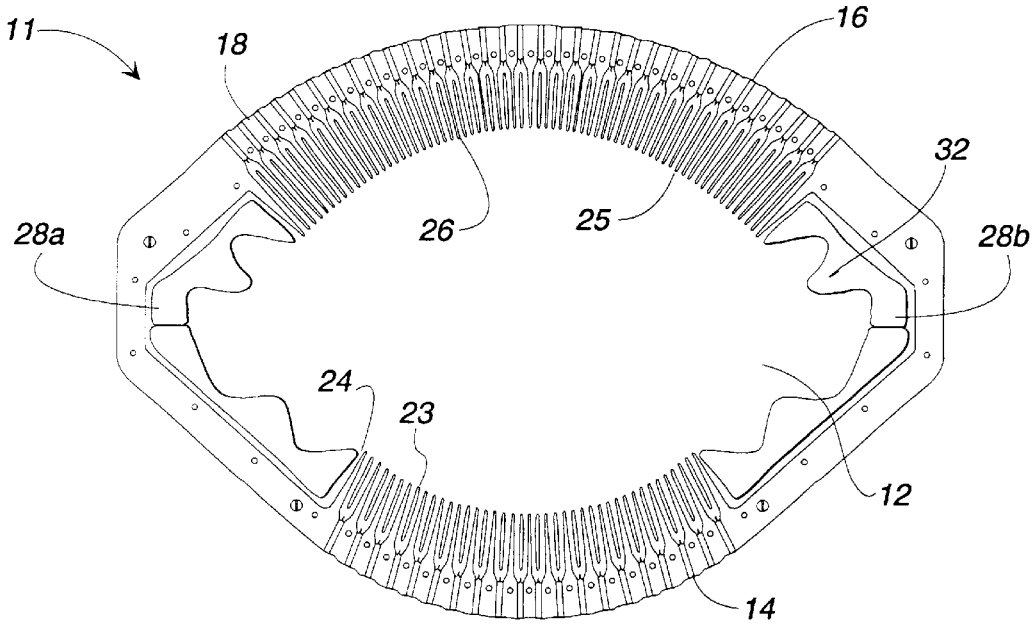
FIG. 2 is a computer aided design view of a first lens half depicting the interior cavity and the beam and array waveguide apertures of the present invention.
Figure 3:
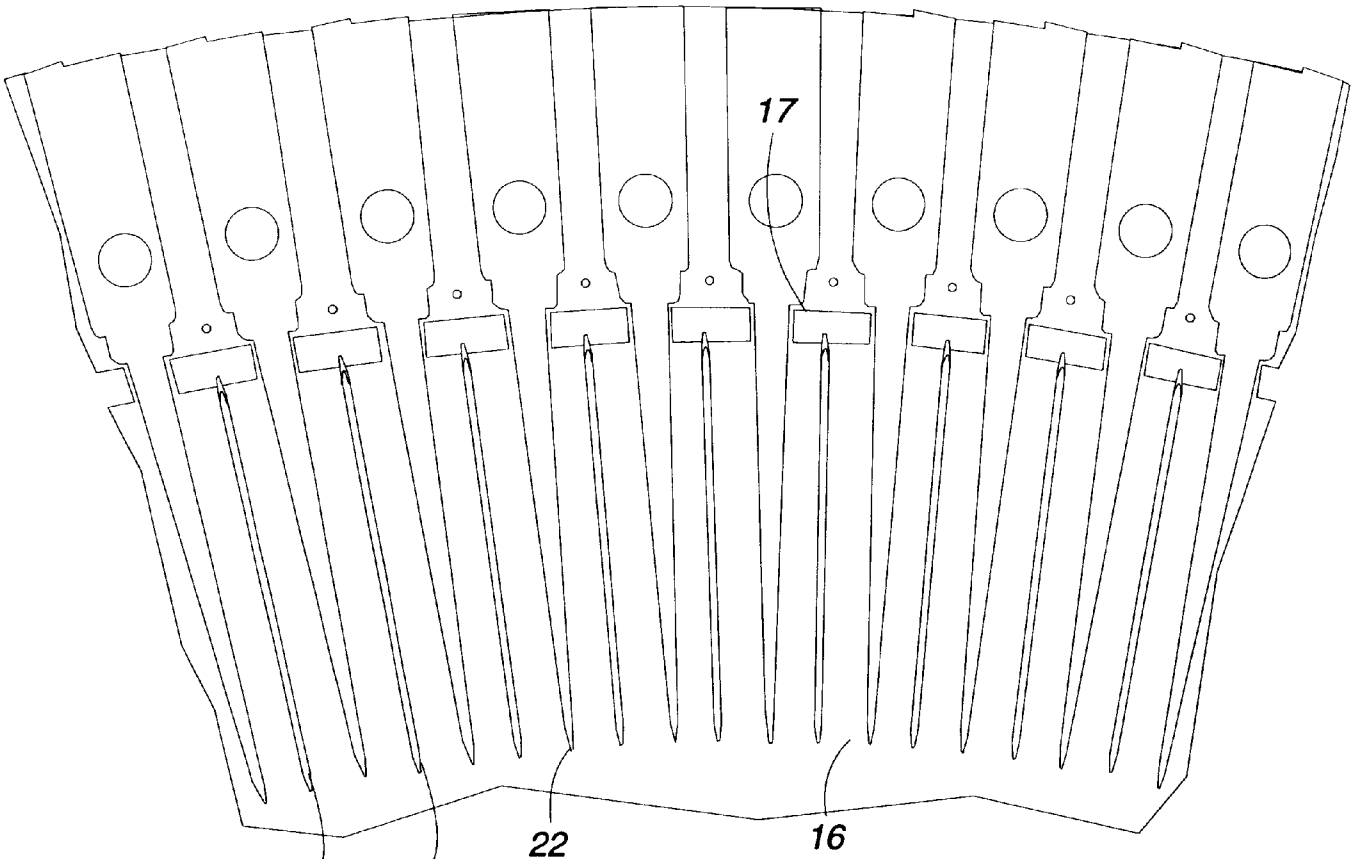
FIG. 3 is a detail view of the waveguide apertures and symmetric power dividers of a second lens half of the present invention.

Referring to FIG. 2, shown is a view of a first lens half 11 depicting the interior cavity 12, the tapered beam waveguides 14 and the tapered array waveguides 16 of the present invention. Because the first and second lens halves are complementary to each other, and differ only with the addition of an additional port in each waveguide coupler of second lens half 12 as is shown in FIG. 3, and impedance matching structures 18 within the waveguides of first lens half 11, the following discussion will refer only to second lens half 12. The following discussion, however, is equally applicable to first lens half 11, with the exception of the discussion of termination port 17.

Rectangular beam waveguides 14 and array waveguides 16 are used to route the electromagnetic energy between beam ports 24 and array ports 26 through lens cavity 12. Impedance is matched within the array waveguides 16 and beam waveguides 14 by the placement of impedance matching structures 18 as is known in the art.

FIG. 3, shows a detail view of the waveguides within second lens half 12 of the present invention. The waveguide detail shown in FIG. 3 is equally applicable to either the tapered beam waveguides 14, or the tapered array waveguides 16. For simplicity, the following discussion will address only the tapered array waveguides 16. It can be seen that the waveguides are generally tapered along their transverse dimension to provide an improved impedance match at the cavity/port boundary 22. Symmetric power divider 21 divides the waveguide into equal sections, each having a dimension of $\lambda_g/2$, or less and will be discussed in detail hereafter. Termination port 17 is located in array waveguide 16 and beam waveguide 14 of second lens half 12, and is designed to include an absorber for terminating millimeter wave energy.

Following is a description of the analytical process used to determine the optimum lens configuration for the present invention. A mathematical description of the N-port device can be obtained in terms of a scattering matrix (S-matrix), which relates the complex-valued amplitudes of input and output signals at a single frequency. For a given waveguide mode input at the n-th port, the amount of output waveguide mode produced in the m-th port can be determined from the S-matrix. The S-matrix, in turn, may be processed further to obtain lens performance parameters such as beam sidelobe levels, insertion loss, and amplitude as well as phase variations at the antenna element array ports.

To compute the S-matrix, the contributions from each mode in each waveguide aperture around the lens must be combined in an integral equation. The integral equation is essentially equivalent to Maxwell's equations and is used to rigorously incorporate all electromagnetic effects, such as mutual coupling and higher order modes, associated with the lens interactions. The discrete form of the integral equation can be rewritten in matrix form, producing a generalized scattering matrix. The generalized S-matrix contains information about the primary (dominant) waveguide modes, as well as higher-order waveguide modes and is defined as follows:

$$\begin{bmatrix} b_1 \\ b_2 \\ \vdots \\ b_{NM} \end{bmatrix} = \begin{bmatrix} S_{11} & S_{12} & \cdots & S_{1,NM} \\ S_{21} & S_{22} & & \vdots \\ \vdots & & \ddots & \\ S_{NM,1} & \cdots & & S_{NM,NM} \end{bmatrix} \begin{bmatrix} a_1 \\ a_2 \\ \vdots \\ a_{NM} \end{bmatrix} \quad (1)$$

The parameters $\{a_{nm}\}$ denote the complex-valued coefficients associated with the m-th mode and n-th port propagating toward the lens interior while the set $\{b_{nm}\}$ denotes the coefficients propagating away from the lens interior. The diagonal elements of the matrix provide information about the energy reflected at each port for a particular mode. Off-diagonal elements yield information about the energy transferred between ports.

Each element of the generalized S-matrix above may be determined by using an integral equation that constrains the waveguide aperture fields around the lens periphery. The integral equation imposes the consistency condition that the total magnetic field in aperture p must be the same as the superposition of the radiated magnetic fields produced there by the various modes of all other waveguide apertures (including aperture p). p is an index and can be any aperture.

In a practical lens configuration, the higher-order modes excited in the apertures of the various ports do not propagate beyond the tapered transition to a single-mode waveguide. Thus, these modes carry no net energy away from the lens, and can be eliminated from the generalized S-matrix by a procedure that accounts for their presence, whereby the generalized scattering matrix of order NM is reduced to an ordinary N by N scattering matrix, where N is the total number of ports. Furthermore, the reference planes associated with the resulting S-matrix can be shifted to other desired locations along the waveguides to compare the computed values with experimental data.

LENS DESIGN The following discussion pertains to the preferred embodiment of the present invention. It is to be understood that variations in lens design are anticipated in order to maximize different parameters, such as scan angle, aperture size and operating frequency. The following preferred embodiment is meant by way of illustration only.

A typical lens design is initiated by solving the Rotman equations, which can be found in W. Rotman and R. F. Turner, *Wide Angle Lens for Line Source Applications*, IEEE Trans. Ant. Propogation. Vol. AP-11, pp. 623–632, November 1963. The output contains, among other quantities, the x, y coordinates for the positions of the tapered 10 beam waveguides 14 and the tapered array waveguides 16. The input parameters for the lens are the number of array elements (34), number of beams (19), element spacing (0.59λ), maximum operating frequency (37 GHz), maximum scan angle (22.2°), and beam length ($15\lambda_g$). The numbers in parentheses are the optimized parameters selected for the preferred embodiment MMW lens of the present invention. λ is the wavelength in air at 37 GHz, and $\lambda_g$ is the guided wavelength within the lens at 37 GHz. Furthermore, the Rotman lens design has three perfect foci located at 0° and the maximum scan angles. In between these angles the foci are not perfect, which means that the path lengths from a particular beam port 24 to the emerging wavefront are not equal. An increase in the focal length will generally decrease the path length errors, but at the expense of increasing the lens size. The focal length was selected so that the design path length errors were ≧2.0°. This choice provided a lens size of about 15 by 11 inches for the preferred embodiment.

Referring back to FIG. 2, the Rotman equations output the beam port contour 23 and the array port contour 25, but does not yield any information about the waveguide type and orientation, or the configuration of sidewall 28 that joins the beam contour 23 to the array contour 25. Because they will affect the sidelobes of the antenna beam patterns, these components are crucial to lens performance. In general, sidewall 28 is lined with dummy ports or an absorber 32 to attenuate spill-over energy. Absorber 32 is typically a carbon loaded material, such as the carbon impregnated foam designated as AEMI-20 and manufactured by Advanced Electromagnetics, Inc. in Santee, Cailf., that absorbs electromagnetic energy. Other MMW absorbing material may be used and may be preferable at higher transmit powers if it can absorb the energy without overheating.

Figure 4:
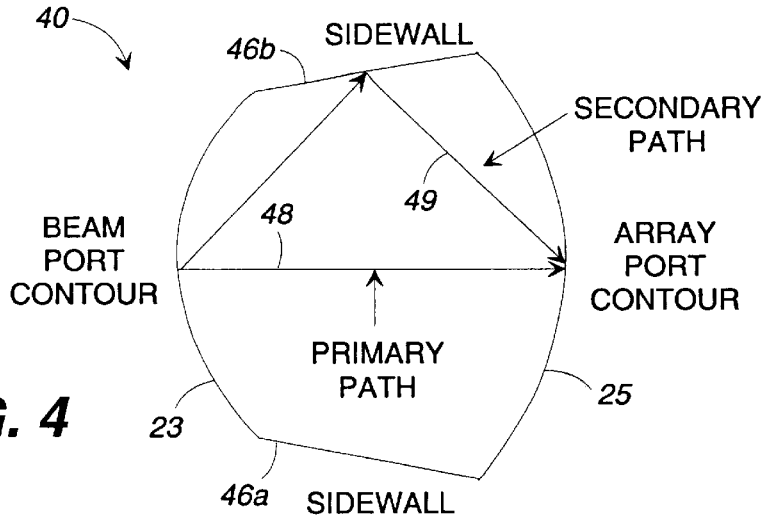
FIG. 4, is a schematic view of an electronically scanned lens depicting the beam port contour and the array port contour of a straight sidewall lens design.
Figure 5:
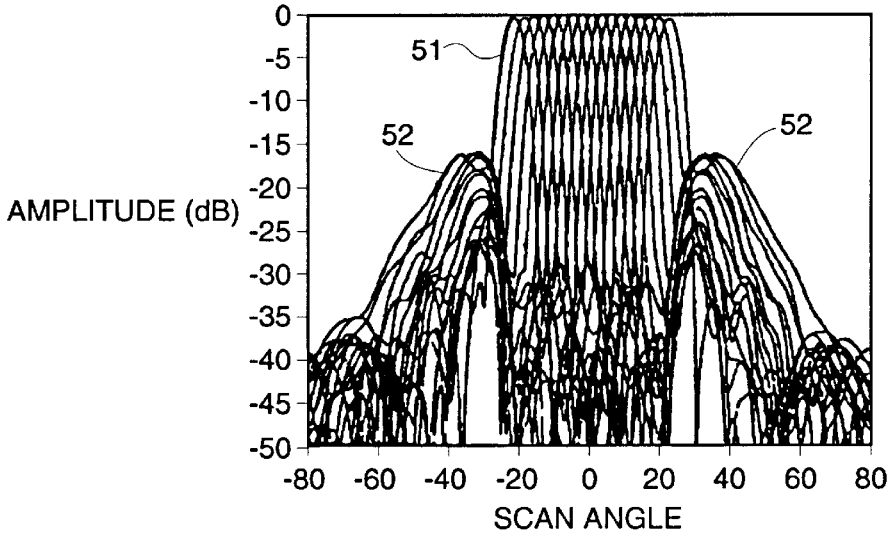
FIG. 5 a view illustrating the computed MMW lens beam patterns of the straight sidewall lens design of FIG. 3.

Referring now to FIG. 4, shown is a schematic view of an electronically scanned lens 40 depicting the beam port contour 23 and the array port contour 25. This view is shown to illustrate the degenerative effect on the primary path 48 of the direct MMW energy beam introduced by straight sidewalls 46. Primary path 48 is the main electromagnetic MMW energy beam emanating from the interior end of beam waveguide 14. A portion of the energy from beam waveguide 14 is radiated to the sidewall. This side radiated energy reflects off of straight sidewall 46 in a secondary path 49 causing the effect of multipath interference with primary path 48. The large path difference between primary path 48 and secondary path 49 leads to rapidly oscillating amplitude and phase ripples along the array ports 26 that yield large far-out sidelobes. FIG. 5 is a view illustrating the computed main electromagnetic MMW energy beam 51 and the far-out sidelobes 52. It can be seen that an unacceptable level of −15 db of sidelobe relative to the main beam is present.

Figure 6:
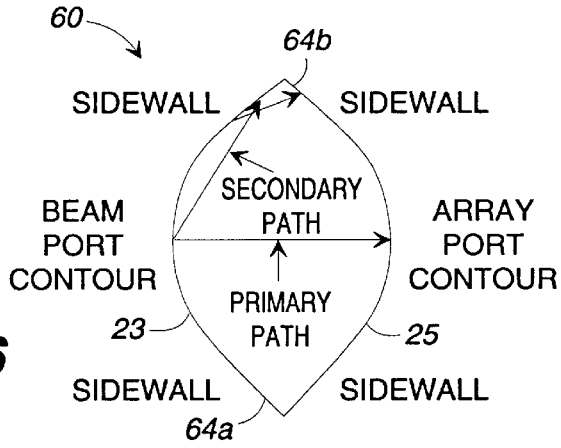
FIG. 6 is a schematic view of an electronically scanned lens depicting the beam port contour, the array port contour, and illustrates the triangular sidewall design of the present invention.
Figure 7:
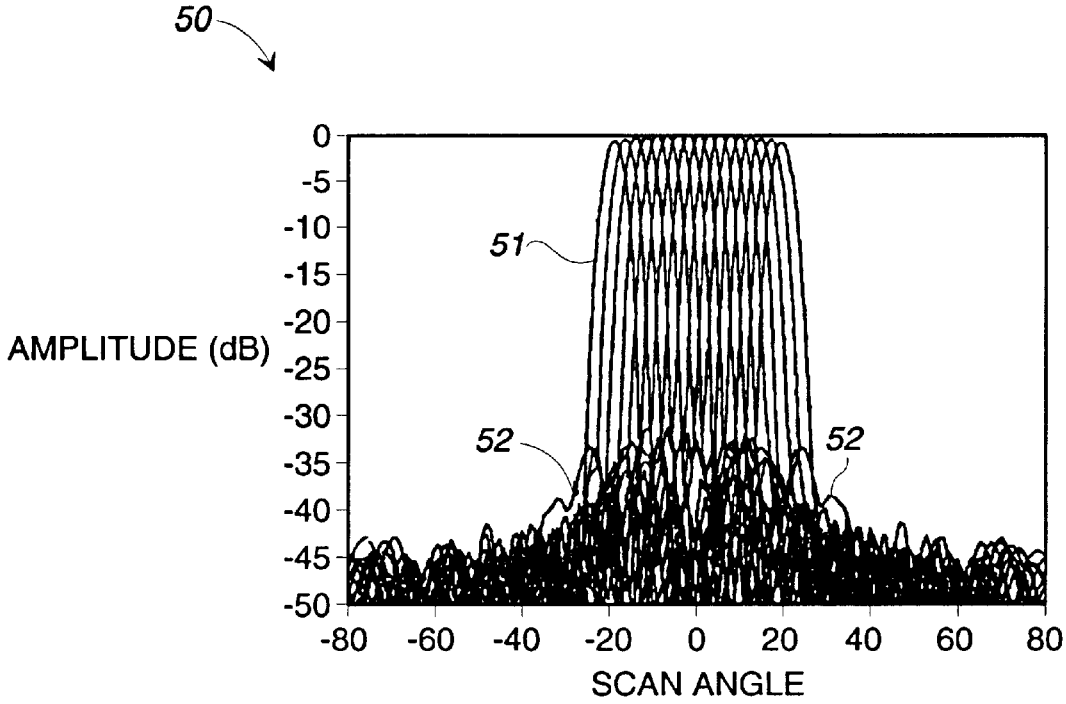
FIG. 7 is a view illustrating the computed MMW lens beam patterns of the triangular sidewall lens design of FIG. 5.

Referring now to FIG. 6, shown is a schematic view of an electronically scanned lens 60 depicting the beam port contour 23, the array port contour 25 and the triangular shaped sidewall 64 design of the present invention. Far-out sidelobes 52 illustrated in FIG. 5 can be eliminated via the incorporation of triangular shaped sidewalls 64 joining beam port contour 23 to array port contour 25. FIG. 7 is a view of the computed MMW lens beam pattern of the present invention using the triangular shaped sidewall design. As can be seen, in relation to the main electromagnetic MMW energy beams 51, sidelobes 52 are at least −30 db down relative to main beam 51. Sidelobe 52 reduction is possible because the triangular shaped sidewall 64 design redirects and confines the multipath energy 49 within the triangular shaped sidewall region.

Sidewall absorber 32 was selected on the basis of low reflection coefficients.

Figure 8:
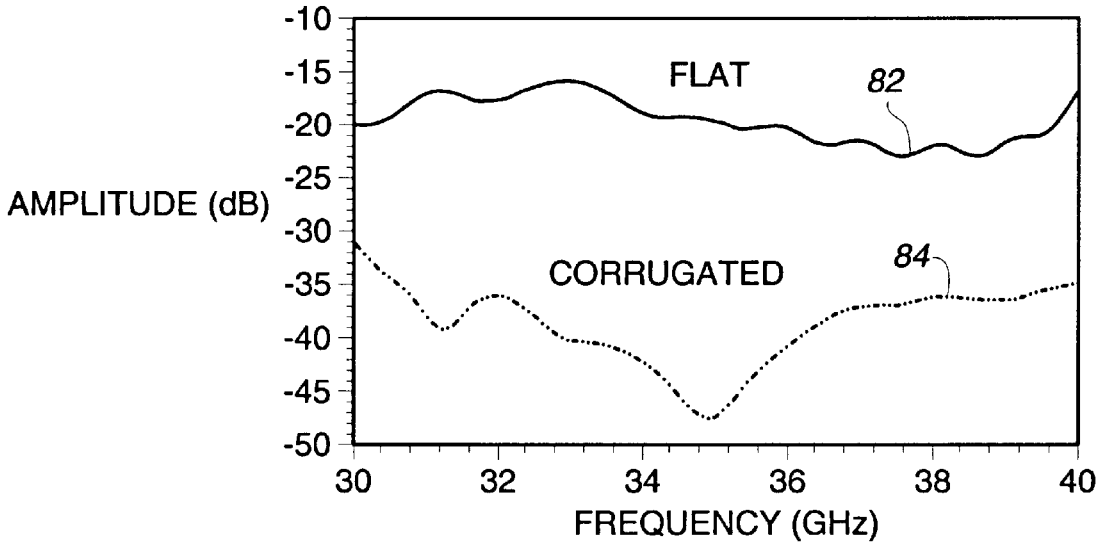
FIG. 8 is a view showing the reflection coefficients for a flat and a corrugated absorber of FIG. 2.

Referring now to FIG. 8, shown are the reflection coefficient curves for a flat absorber 82 and a corrugated absorber 84. The measured reflection coefficients are shown as a function of frequency. Both the incident and reflection angle was 0°. The upper curve 72 was produced by a flat absorber surface. Lower reflection coefficients i.e., ≧−35 dB between 33 and 37 GHz were measured for a corrugated (or egg-crate) surface.

Even lower coefficients (<40 dB) were observed when the angle between the incident and reflected rays was greater than 0°. For this reason, the corrugated surface absorber 84 was incorporated into this preferred embodiment.

Proper design of the sidewalls as discussed above controls the sidelobe energy outside of the maximum scan angles of the lens. The sidelobes between the maximum scan angles (i.e., close-in sidelobes) are primarily affected by the array and beam port design, not the sidewall. In general, both the tapered beam waveguides 14 and the tapered array waveguides 16 expand toward the lens cavity to provide a better impedance match between the waveguides and the lens cavity 12. However, the point of maximum expansion at the waveguide lens cavity interface 22 must be restricted to less than $\lambda_g/2$ where $\lambda_g$ is the guided wavelength at the upper design frequency (37 GHz in this preferred embodiment), otherwise electromagnetic energy, received from adjacent ports due to mutual coupling, will be transferred into higher order modes within the waveguide taper. Because the waveguides only support the fundamental $TE_{10}$ mode, the higher order modes cannot propagate through the waveguides, but instead are reflected back into the lens interior. The reflected energy will interfere with energy from the primary path. The small difference between the primary and reflected paths will cause slowly varying phase and amplitude ripples along the array ports. These ripples, in-turn, will result in high close-in sidelobes.

Figure 9:
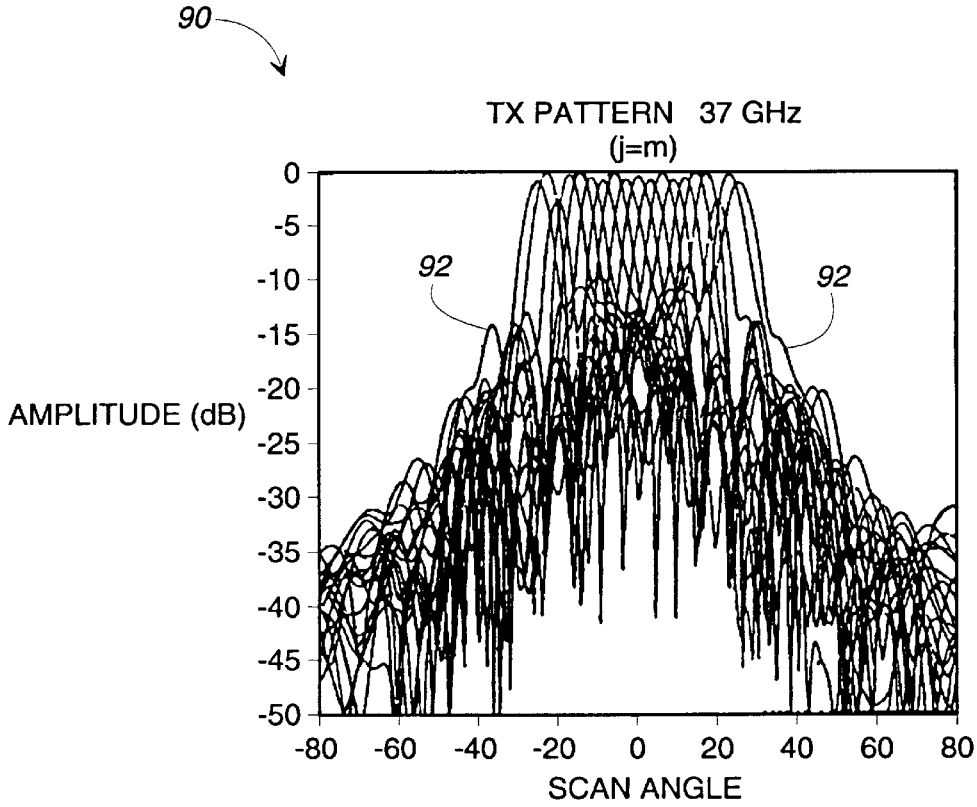
FIG. 9 is a view illustrating the computed beam patterns resulting from port widths greater than $\lambda_g/2$.

A lens design with port widths greater than $\lambda_g$ was input into the computer model. FIG. 9 is a view illustrating the computed beam patterns 90 resulting from port widths greater than $\lambda_g/2$. As can be seen, sidelobes 92 in excess of −15 dB are observed. This problem was solved by splitting each port into two and by combining the two split ports at the output.

Referring back to FIG. 3, symmetric power dividers 21 extend longitudinally from the wide tapered end of array waveguide 16 to the narrow tapered end of array waveguide 16. While FIG. 3 depicts tapered array waveguides 16, symmetric power dividers 21 are also present in the tapered beam waveguides 14. Placement of symmetric power dividers 21 in the array waveguides 16 and beam waveguides 14 results in waveguide dimensions smaller than $\lambda_g/2$, thus reducing phase and amplitude ripples at the array ports, resulting in reduced close-in sidelobe energy. Referring back to FIG. 7, shown are the computed beam patterns 50 resulting from this design, which included a triangular sidewall. As can be seen, in relation to the main electromagnetic MMW energy beams 51, sidelobes 52 are reduced to a level 30 db below the peak of the main beam 51.

ALTERNATE EMBODIMENT WAVEGUIDE

Figure 14:
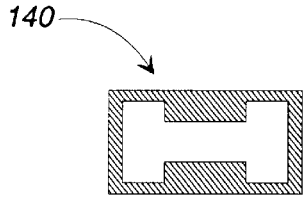
FIG. 14 is a profile view illustrating an alternate embodiment waveguide of the lens of FIG. 1.

Referring now to FIG. 14, shown is a profile view of an alternate embodiment of the waveguide used in the present invention. The incorporation of double ridged waveguide 140 for beam waveguide 14 and array waveguide 16 allows a much larger bandwidth for this embodiment. Furthermore, the double ridged waveguide allows the effective aperture of the waveguide to remain smaller than $\lambda_g/2$ at the highest frequency of interest, while eliminating the need for symmetric power dividers because of the increased bandwidth.

OPERATION

In operation, the tapered beam waveguides 14 are energized with millimeter waves from a switch array that is not part of the present invention. The energy is conducted through the tapered beam waveguides 14 and projected into internal cavity 12. Internal cavity 12 conducts the energy to the corresponding tapered array waveguides 16. The energy is then conducted to an antenna array element that is not part of the present invention. The antenna element array produces an energy beam along a particular direction. By switching the input among tapered beam waveguides 14, the energy beam can be electronically steered along one dimension, resulting in an inertialess MMW electronically steered lens.

MEASUREMENTS

The following measurements were taken using the preferred embodiment of the lens of the present invention and is intended to be illustrative only.

S-parameters were measured with an HP 8510B network analyzer, an HP 8340B synthesized sweeper and an HP 8516A test set. The HP 8510B processor was connected to a 80486 personal computer via an IEEE 488 interface card. The computer read the $S_{11}$, $S_{12}$, $S_{21}$ and $S_{22}$ at 51 frequencies between the 30 to 40 GHz band and stored the data on the hard disk.

Figure 10:
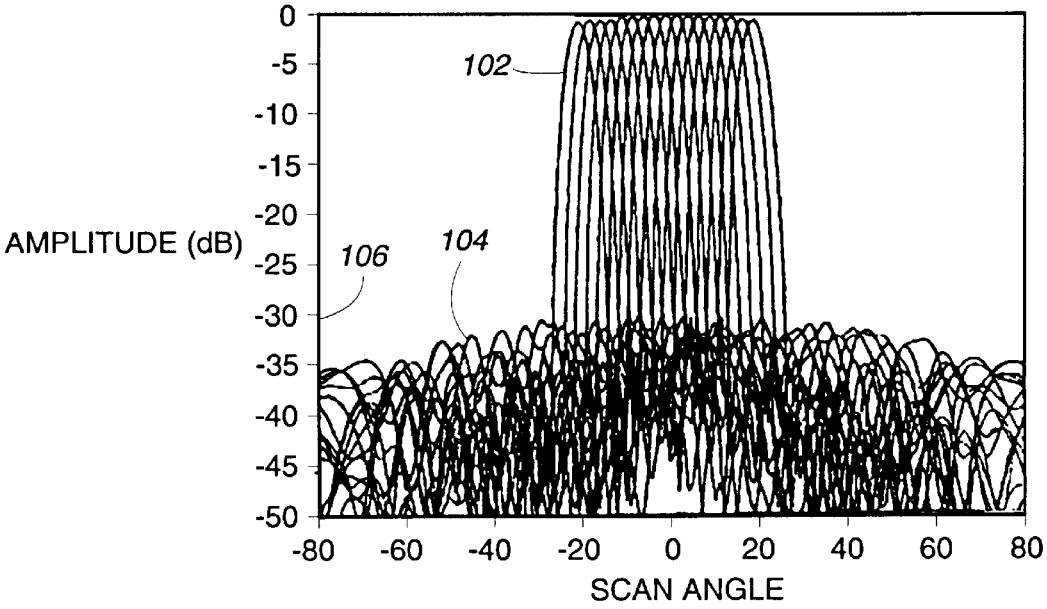
FIG. 10 is a view illustrating the measured beam patterns for the MMW lens of the present invention at 32.8 GHz.
Figure 11:
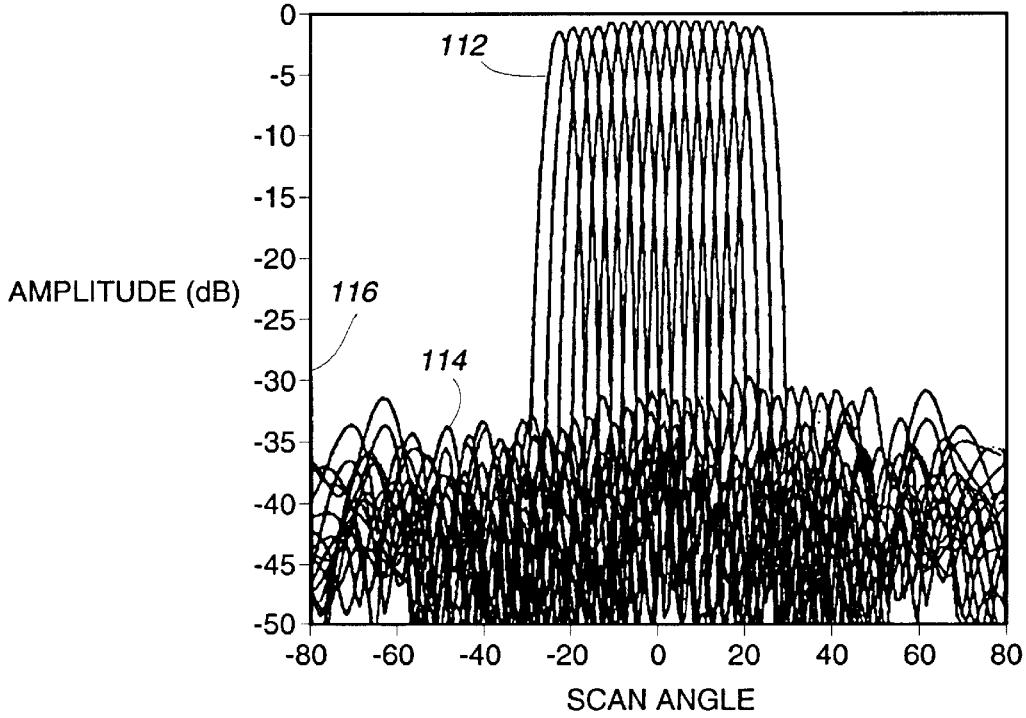
FIG. 11 is a view illustrating the measured beam patterns for the MMW lens of the present invention at 36.8 GHz.

The S-matrix was processed further to determine the beam patterns and insertion loss of the lens. The beam patterns were determined with Equation 2

$$P_{K\theta} = 20\log\left|\sum_l W_l S_{Kl} e^{-j\phi_{Kl}(\theta)}\right| \tag{2}$$

where K denotes a specific beam port. The term $$\sum_l W_l S_{Kl} e^{-j\phi_{Kl}}$$

represents the vectorial sum of all S-parameters from the Kth beam port to all l array ports. $\emptyset_{Kl}(\theta)$ is the phase that must be added to the $l^{th}$ array port to determine the power radiated in a particular direction θ due to the excitation of the K beam port. $\emptyset_{Kl}(\theta)$ is given by $$\phi_{Kl}=(2\pi d_l \sin\theta)/\lambda \tag{3}$$

where $d_l$ is the distance from the center of the antenna array to the $l^{th}$ antenna element. In this case, $$d_l=\pm(0.5+l)0.59\lambda, \text{ where } l=0,1,2,\ldots,M \tag{4}$$

and M=15. The $w_l$ are the components of a Taylor weighting function to suppress the sidelobes. In this case, the Taylor function was configured to yield −40 dB sidelobes for an ideal beam pattern. The resultant output is a series of plots as a function of the scan angle θ. Each plot corresponds to the excitation of one beam port. Referring to FIGS. 10 and 11 respectively, shown are the beam patterns computed in this manner at 32.8 GHz and 36.8 GHz using the measured S-matrix components of the MMW lens. As can be seen, each pattern contains the main lobes 102, 112, that are associated with the various beam ports, plus the superposition of all sidelobes 104 114 from all K beam patterns. A visual inspection shows a maximum sidelobe level of <−30 dB 106, 116. The insertion loss, also derived from the S-parameters, is given by Equation 5.

$$L_K = -10\log\sum_l |S_{Kl}|^2 \tag{5}$$

$|S_{Kl}|^2$ represents the power at the $l^{th}$ array port due to the $K^{th}$ beam port.

Figure 12:
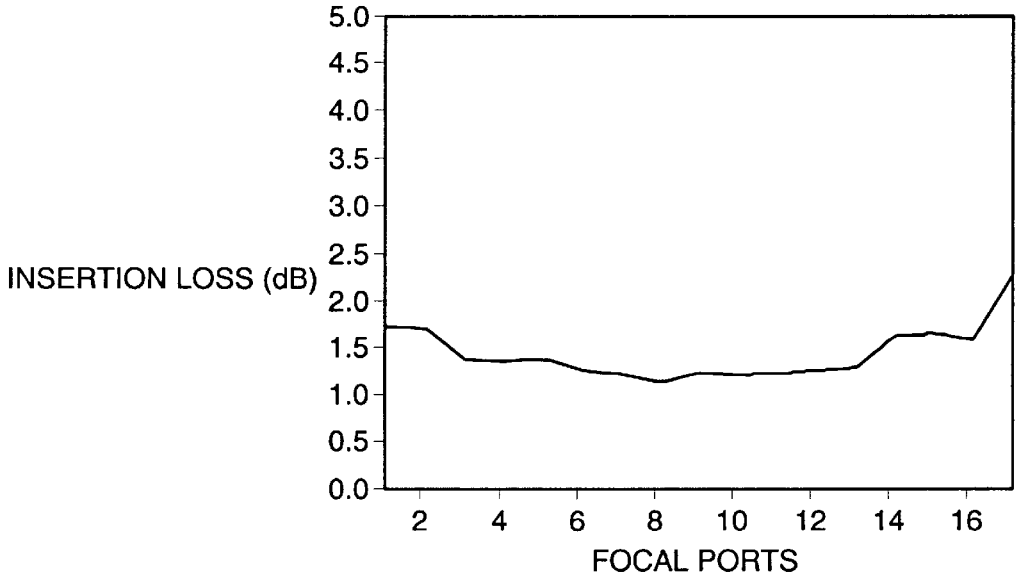
FIG. 12 is a view illustrating the measured insertion loss for all K beam ports of the lens of FIG. 1 at 32.8 GHz.
Figure 13:
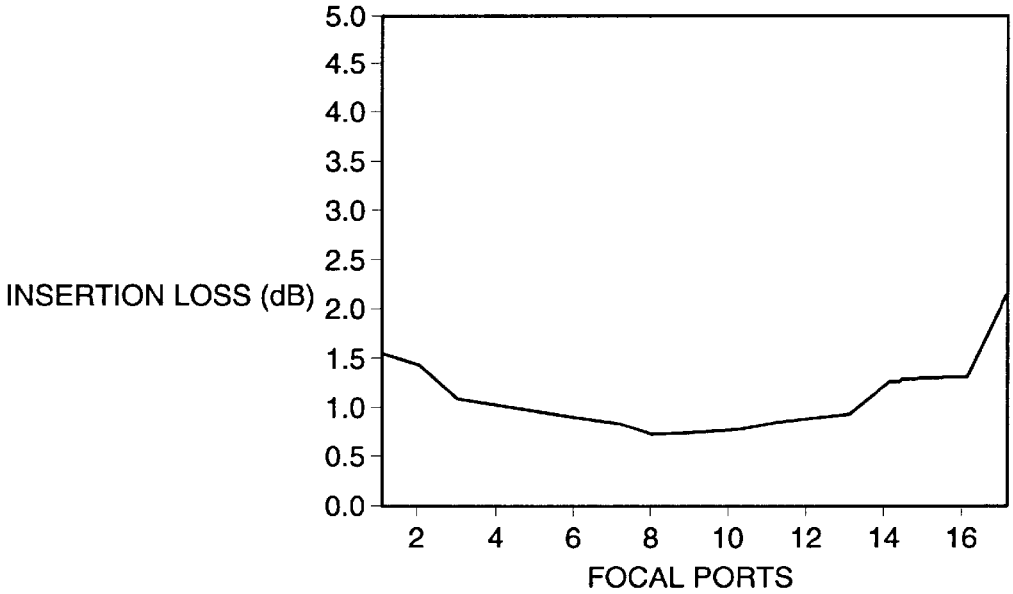
FIG. 13 is a view illustrating the measured insertion loss for all K beam ports of the lens of FIG. 1 at 36.8 GHz.

Referring to FIGS. 12 and 13 respectively, shown is the measured insertion loss at 32.8 and 36.8 GHz for all K beam ports. The losses range between 0.8 and 2.3 dB.

Furthermore, by feeding only the central beam port, the Rotman lens of the present invention operates as a new low loss power divider that can be used as a feed for other antennas. The beam for this feed is stationary and is not scanned.

It will be obvious to those skilled in the art that many modifications and variations may be made to the preferred embodiments of the present invention, as set forth above, without departing substantially from the principles of the present invention. For example, but not limited to the following, it is possible to implement the present invention with a variety of beam and array port configurations in order to maximize various parameters. It is possible to manufacture the lens halves of the present invention from various inexpensive materials such as a stable metallized thermoplastic in order to minimize production costs. All such modifications and variations are intended to be included herein within the scope of the present invention, as defined in the claims that follow.

In the claims set forth hereinafter, the structures, materials, acts, and equivalents of all "means" elements and "logic" elements are intended to include any structures, materials, or acts for performing the functions specified in connection with said elements.

Therefore, the following is claimed:

1. An electronically scanned lens for directing millimeter wave (MMW) energy, comprising;

a first curvilinear wall having a plurality of metalized rectangular MMW beam waveguides radially dispersed thereabout, said metalized rectangular MMW beam waveguides having an interior end and an exterior end;

a second curvilinear wall, opposing said first curvilinear wall, having a plurality of metalized rectangular MMW array waveguides radially dispersed thereabout, said metalized rectangular MMW array waveguides having an interior end and an exterior end; and a plurality of sidewalls connecting said first curvilinear wall and said second curvilinear wall, forming a specially shaped cavity recessed between said first curvilinear wall and said second curvilinear wall, around which said plurality of metalized rectangular MMW beam waveguides and said plurality of metalized rectangular MMW array waveguides are radially dispursed, said interior ends of said plurality of metalized rectangular MMW beam waveguides and said interior ends of said plurality of metalized rectangular MMW array waveguides in electromagnetic communication with a boundary edge of said specially shaped cavity, said specially shaped cavity designed to directionally radiate MMW electromagnetic energy from said plurality of metalized rectangular MMW beam waveguides on said first curvilinear wall to said plurality of metalized rectangular MMW array waveguides on said second curvilinear wall, said plurality of metalized rectangular MMW beam waveguides and said plurality of metalized rectangular MMW array waveguides disposed about the periphery of said specially shaped cavity in order to affect the directional radiation of MMW energy.

2. The lens according to claim 1, further comprising MMW energy absorbing material disposed within the opposing distal ends of said specially shaped cavity, said opposing distal ends formed by said plurality of sidewalls, for attenuating reflected multipath MMW energy.

3. The lens according to claim 1, wherein said metalized rectangular MMW beam waveguides and said metalized rectangular MMW array waveguides are continuously tapered, such that said interior end is wider than said exterior end.

4. The lens according to claim 3, further comprising a symmetric power divider disposed longitudinally within a substantial portion of each of said plurality of tapered metalized rectangular MMW beam waveguides and tapered metalized rectangular MMW array waveguides, extending from said interior end of said tapered metalized rectangular MMW beam waveguide and said interior end of said tapered metalized rectangular MMW array waveguide, said symmetric power divider effectively dividing said tapered metalized rectangular MMW beam waveguide and said tapered metalized rectangular MMW array waveguide in two discrete equal portions, each of said portion being smaller than ½ of the operating wavelength, at the upper design frequency limit, of the electromagnetic wave, in order to attenuate the sidelobe radiation associated with a radiated MMW energy beam.

5. The lens according to claim 1, wherein said metalized rectangular MMW beam waveguides and said metalized rectangular MMW array waveguides are double ridged waveguides.

6. The lens according to claim 1, wherein said first curvilinear wall, said second curvilinear wall, and said sidewalls are of a two piece construction, fabricated from a metallized plastic material, whereby two complementary lens halves are assembled to form said lens.

7. A method for forming a beam of millimeter wave (MMW) energy, comprising the steps of:

supplying input energy in the form of a MMW electromagnetic wave to a beam port of a lens;

conducting said electromagnetic wave through a tapered metalized rectangular MMW beam waveguide;

conducting said electromagnetic wave from an interior end of said tapered metalized rectangular MMW beam waveguide through a specially shaped cavity;

conducting said electromagnetic wave from said specially shaped cavity to an interior end of a corresponding tapered metalized rectangular MMW array waveguide;

conducting said electromagnetic wave through said tapered metalized rectangular MMW array waveguide to an array port of said lens; and projecting said electromagnetic wave out of said array port to an antenna element.

8. A method for steering millimeter wave (MMW) energy, comprising the steps of:

communicating MMW energy to a Rotman lens, said Rotman lens having a plurality of metalized rectangular MMW beam waveguides and a plurality of metalized rectangular MMW array waveguides; and propagating said MMW energy from said Rotman lens in a selectable desired direction.

9. A method for steering millimeter wave (MMW) energy, comprising the steps of:

determining a desired beam direction; and communicating MMW energy to an appropriate input port of a Rotman lens, said Rotman lens having a plurality of metalized rectangular MMW beam waveguides and a plurality of metalized rectangular MMW array waveguides, in order to communicate said MMW energy in said desired beam direction.

* * * * *

UNITED STATES PATENT AND TRADEMARK OFFICE

CERTIFICATE OF CORRECTION

PATENT NO. : 6,031,501
DATED : February 29, 2000
INVENTOR(S) : Rausch et al.

It is certified that error appears in the above-identified patent and that said Letters Patent is hereby corrected as shown below:

Title page,
Title page, should be deleted to be replaced with the attached title page.

Drawings,
On drawing sheet 1 of 7, Fig. 2, should be deleted to be replaced with Fig. 2, as shown on the attached page.

Signed and Sealed this

Nineteenth Day of February, 2002

*Attest:*

*Attesting Officer*

JAMES E. ROGAN
*Director of the United States Patent and Trademark Office*

United States Patent [19]

Rausch et al.

[11] Patent Number: 6,031,501

[45] Date of Patent: Feb. 29, 2000

[54] LOW COST COMPACT ELECTRONICALLY SCANNED MILLIMETER WAVE LENS AND METHOD

[75] Inventors: Ekkehart O. Rausch; Andrew F. Peterson, both of Atlanta, Ga.

[73] Assignee: Georgia Tech Research Corporation, Atlanta, Ga.

[21] Appl. No.: 08/820,166

[22] Filed: Mar. 19, 1997

[51] Int. Cl.[7] ..... H01Q 19/06

[52] U.S. Cl. ..... 343/754; 343/753; 343/768; 343/776

[58] Field of Search ..... 343/753, 754, 343/756, 768, 776; 342/368; 385/132, 50, 33

[56] References Cited

U.S. PATENT DOCUMENTS

| | | | |
|---|---|---|---|
| 3,170,158 | 2/1965 | Rotman | 343/100 |
| 3,369,242 | 2/1968 | Johnson | 343/754 |
| 3,534,374 | 10/1970 | Johnson | 343/768 |
| 3,604,009 | 9/1971 | Behnke | 343/754 |
| 3,680,140 | 7/1972 | Chalfin et al. | 343/754 |
| 3,852,762 | 12/1974 | Henf et al. | 343/756 |
| 3,964,069 | 6/1976 | McDonough | 343/754 |
| 3,979,754 | 9/1976 | Archer | 343/754 |
| 4,021,810 | 5/1977 | Urpo et al. | 343/731 |
| 4,042,931 | 8/1977 | Gustafsson | 343/117 R |
| 4,086,597 | 4/1978 | Sinsky et al. | 343/754 |
| 4,114,162 | 9/1978 | Wild | 343/754 |
| 4,186,398 | 1/1980 | Minnett et al. | 343/100 SA |
| 4,203,117 | 5/1980 | Jacobs et al. | 343/701 |
| 4,243,990 | 1/1981 | Nemit et al. | 343/771 |
| 4,288,795 | 9/1981 | Shelton | 343/754 |
| 4,348,678 | 9/1982 | Thomas | 343/754 |
| 4,348,679 | 9/1982 | Shnitkin et al. | 343/768 |
| 4,381,509 | 4/1983 | Rotman et al. | 343/754 |
| 4,408,205 | 10/1983 | Hockham | 343/16 |
| 4,413,263 | 11/1983 | Amitay et al. | 343/756 |
| 4,458,249 | 7/1984 | Valentino et al. | 343/754 |
| 4,490,723 | 12/1984 | Hardie et al. | 343/754 |
| 4,575,727 | 3/1986 | Stern et al. | 343/768 |
| 4,588,994 | 5/1986 | Tang et al. | 343/754 |
| 4,612,547 | 9/1986 | Itoh | 343/372 |
| 4,636,799 | 1/1987 | Kubick | 343/754 |
| 4,641,144 | 2/1987 | Prickett | 343/754 |
| 4,721,960 | 1/1988 | Lait | 342/368 |
| 4,721,966 | 1/1988 | McGrath | 343/754 |
| 4,809,011 | 2/1989 | Kunz | 343/754 |

(List continued on next page.)

OTHER PUBLICATIONS

P.S. Hall et al., "Review of Radio Frequency Beamforming Techniques for Scanned and Multiple Beam Antennas" IEE Proceedings, vol. 137, Pt.H, No. 5, Oct., 1990.

W. Rotman et al., "Wide-Angle Microwave Lens for Line Source Applications" IEEE Transactions on Antennas and Propagation, Nov., 1963, pp. 623–632.

*Primary Examiner*—Don Wong

*Assistant Examiner*—Hoang Nguyen

*Attorney, Agent, or Firm*—Thomas, Kayden, Horstemeyer & Risley

[57] ABSTRACT

A low cost, compact, electronically scanned millimeter wave (MMW) lens enables the projection of a highly directional beam of Ka band millimeter wave (MMW) electromagnetic energy, while eliminating the need for mechanical movement of the lens. The present invention allows for the economical production and operation of the lens in the Ka and higher frequency ranges by exploiting waveguide technology. The waveguides of the present invention are tapered longitudinally resulting in a wider portion of the waveguide in electromagnetic communication with an interior cavity of the lens. The waveguide taper improves impedance matching between the waveguides and the lens cavity. The waveguides also include symmetric power dividers, located longitudinally within the waveguide aperture, ensuring port widths below $\lambda_g/2$, thus, reducing or eliminating unwanted mode components which reduces sidelobe energy. This results in a low loss, low sidelobe steerable beam of MMW energy.

9 Claims, 7 Drawing Sheets

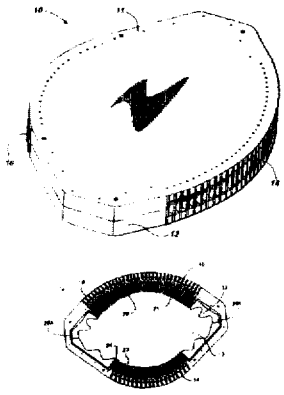

UNITED STATES PATENT AND TRADEMARK OFFICE

CERTIFICATE OF CORRECTION

PATENT NO. : 6,031,501
DATED : February 29, 2000
INVENTOR(S) : Rausch et al.

It is certified that error appears in the above-identified patent and that said Letters Patent is hereby corrected as shown below:

Please replace FIG. 2 with the following:

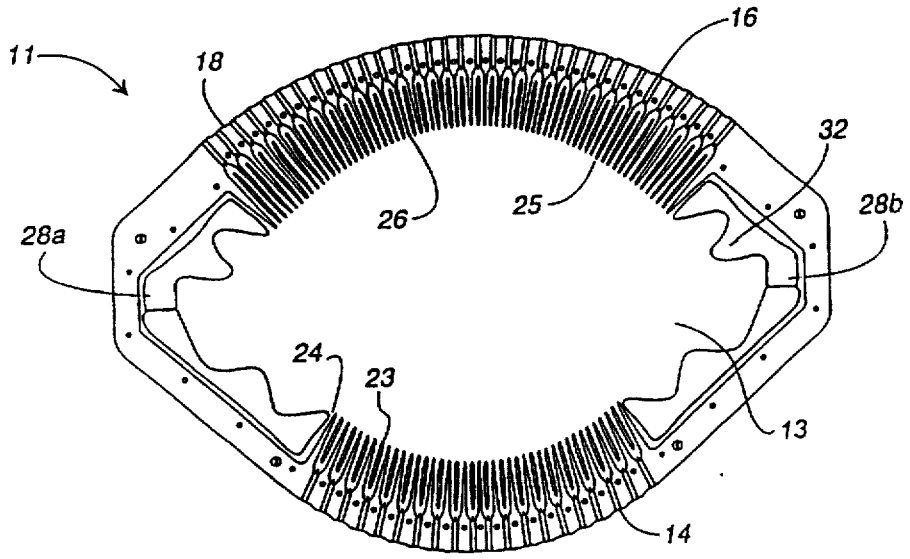

FIG. 2

UNITED STATES PATENT AND TRADEMARK OFFICE

CERTIFICATE OF CORRECTION

PATENT NO. : 6,031,501
DATED : February 29, 2000
INVENTOR(S) : Rausch et al.

It is certified that error appears in the above-identified patent and that said Letters Patent is hereby corrected as shown below:

Column 1,
Line 17 insert --
Statement Regarding Federally Sponsored Research or Development The U.S. Government has a paid-up license in this invention and the right in limited circumstances to require the patent owner to license others on reasonable terms as provided for by the terms of contract No. DAAL01-95-0059 awarded by the United States Army Research Laboratory. --.

Coulmn 2,
Line 64, after "compact" add -- ,--.

Column 3,
Line 52, delete "5" and substitute therefor -- 6 --.

Column 4,
Lines 17 and 30, delete "12" and substitute therefor -- 13 --.

Column 5,
Line 13, delete "$a_{nm}$" and substitute therefor -- $a_{NM}$ --.
Line 15, "delete "$b_{nm}$" and substitute therefor -- $b_{NM}$ --.
Line 41, after "LENS DESIGN" move the sentence beginning with "The following" to the next line.
Line 52, delete "10".

Column 6,
Line 58, delete "72" and substitute therefor -- 82 --.

Column 7,
Line 7, delete "12" and substitute therefor -- 13 --.
Line 59, delete both occurrences of "12" and substitute therefor -- 13 --.